United States Patent [19]

Wilson

[11] Patent Number: 4,919,604

[45] Date of Patent: Apr. 24, 1990

[54] FINISHING TOOL

[76] Inventor: Jim Wilson, 20987 Turner Dr., Tulare, Calif. 93274

[21] Appl. No.: 245,040

[22] Filed: Sep. 16, 1988

[51] Int. Cl.[5] ..... E04F 21/06; E04F 21/16

[52] U.S. Cl. ..... 425/458; 15/104 S; 15/235.7; 401/139

[58] Field of Search ..... 425/87, 90, 458; 15/235.4, 235.7, 104 S, 235.3, 235.8, 245, 105.5; 401/137, 138, 139, 5, 48

[56] References Cited

U.S. PATENT DOCUMENTS

| | | | |
|---|---|---|---|
| 1,000,333 | 8/1911 | Hall | 425/458 |
| 1,083,099 | 12/1913 | Howg | 15/235.8 |
| 1,411,651 | 4/1922 | Weismann | 425/458 |
| 1,512,920 | 10/1924 | Galvin | 425/458 |
| 1,868,013 | 7/1932 | Humphreys | 15/235.4 |
| 2,188,114 | 1/1940 | Hubbard | 15/245 |
| 2,193,390 | 3/1940 | Bussert | 425/458 |
| 2,301,498 | 11/1942 | Ames | 425/458 |
| 2,670,491 | 3/1954 | Stoner et al. | 15/104 S |
| 2,725,740 | 12/1955 | Borgstrom | 15/235.4 |
| 2,882,716 | 4/1959 | Anderson | 401/139 |
| 2,896,441 | 7/1959 | Tucker | 15/235.8 |
| 2,968,057 | 1/1961 | Pratt | 425/458 |
| 3,078,491 | 2/1963 | Ames | 15/104 S |
| 3,087,654 | 4/1963 | Moore | 425/87 |
| 3,206,788 | 9/1965 | Hahn | 15/235.8 |
| 3,341,878 | 9/1967 | Hubbard | 15/235.4 |
| 3,821,828 | 7/1974 | Pearson | 425/458 |
| 3,964,854 | 6/1976 | Groeneveld | 425/87 |
| 4,258,898 | 3/1981 | Tuzzolino | 425/418 |
| 4,669,970 | 6/1987 | Perry | 15/235.7 |
| 4,784,598 | 11/1988 | Kranz et al. | 15/105.5 |

*Primary Examiner*—Jeffery Thurlow
*Assistant Examiner*—Mathieu Vargot
*Attorney, Agent, or Firm*—Dennis B. Haase

[57] ABSTRACT

The present invention includes a specialized tool for finishing drywall surfaces in areas where there is a joinder of those surfaces at an included angle greater than 90°. The tool has an arcuate blade having a handle protruding from its diametral edge, and with a spine extending longitudinal outward from the handle along a radius of the arcuate blade to a point in proximity to the edge of the blade. The blade is of uniform thickness and terminates in a finishing edge which is tapered to a thinner leading edge. Further, the tool has tapered raised portions fanning out from the spine to enhance control and stability of the finishing edge.

8 Claims, 1 Drawing Sheet

FINISHING TOOL

The present invention relates to tools or devices for applying cementious materials in a fashion which results in a smooth, uniform, seamless appearance to a surface located in otherwise hard to reach places, and is particularly adept at applying taping or finishing compound over dry wall seams to provide such a surface in corners having an included angle which is obtuse.

BACKGROUND OF THE INVENTION

The second World War brought about many profound changes in the housing industry which carried over into the post-war era. The exigencies of war resulted in development of both materials and methods for the creation of large volumes of housing which could be constructed quickly, and inexpensively. Under such circumstances, interior walls of such structures, could not, as a practical matter, abide the luxury of the more time honored, and in the early forties, the more dominant form of interior wall, i.e., lath and plaster. While its durability and effectiveness as a insulator was unquestioned, the time and cost of construction, not to mention scarcity of wire, was unacceptable, and militated against its use.

Thus, the development of dry-wall, a sheet of compressed gypsum-like material sandwiched between two sheets of heavy paper. The product, which typically sold in four foot by eight foot sheets, could be literally thrown up to create an acceptable interior wall quickly and inexpensively. Whatever it may have lacked in aesthetics, in its early usage, was excused by virtue of its expediency.

In the post-war era, and beginning in the early fifties, dry-wall applications in residential housing began to proliferate, notwithstanding the resistance from craftsman who had applied lath and plaster for many years. However, to be acceptable in residential housing, it became necessary to be able to finish the interior wall surface in such a manner that, at least the casual observer would not be able to observe the difference between a dry-wall surface and that of lath and plaster without close examination.

The single most difficult aspect of disguising a dry-wall installation is being able to cover up rough seams between contiguous sheets and to be able to finish off corners so that they have the appearance and smoothness of plaster. While it would be nice to find uniformity in the dry-wall industry, the realities are that every piece is not a perfect four by eight rectangle, nor is every corner square, and when a piece needs to be saw cut to fit a particular space, the likelihood of that piece being "square" is even more remote. Dry-wall seams are typically "taped", and a taping or finishing compound is then smoothed over the taped area in order to visually bring the seams together into a "oneness", which makes the seam appear to disappear. When the seam is in a corner, and particularly a corner in which the contiguous surfaces of the sheets form an obtuse angle, application of the finishing compound becomes even more difficult, while at the same time being more acute in terms of providing the visual appearance of "oneness".

Overview of Related Prior Art

While the basic tool of the dry-wall craftsman is the trowel, the problem of being able to obtain smooth seams in hard to reach and peculiarly shaped areas has been addressed by some inventive minds. For example, Borgstrom U.S. Pat. No. 2,725,740 provides a modified trowel in which the working surface is flexible with means provided near the outer edges of the working surface to permit deformation thereof in a convex configuration which of course leaves a "mound" of compound. One of the very early patents in the field dates back to 1913, when C. M. Hogg obtained U.S. Pat. No. 1,083,099 on his adjustable plastering trowel. Still other innovations include Humphrey's U.S. Pat. No. 1,868,013 and Tucker U.S. Pat. No. 2,896,441. One of the newest additions to the field includes Perry U.S. Pat. No. 4,669,970, which again, as in Borgstrom, provides flexibility for finishing corners and edges extending outwardly towards the room, as distinguished from corners having an included obtuse angle such as that for which the present invention has particular, although not exclusive utility.

SUMMARY OF INVENTION

In summary, it is an objective of the present invention to provide a unique finishing tool, primarily for use in corners, having an included obtuse angle, and which is capable of providing a smooth and barely discernible transition at the seam.

It is another objective of the present invention to permit a dry-wall applicator to obtain a smooth transition between dry-wall sheets in a corner having an included obtuse angle in a quick, efficient, and inexpensive manner.

It is yet another objective of the present invention to accomplish all of the foregoing objectives with such ease that even less skilled craftsman will be able to obtain highly satisfactory results.

DESCRIPTION OF THE DRAWINGS

With the foregoing offered by way of background and environment, a preferred embodiment of the invention herein is depicted in the several views of the drawing wherein.

DESCRIPTION OF A PREFERRED EMBODIMENT

Figures 1, 2, 3, 4, 5, 6, 7:
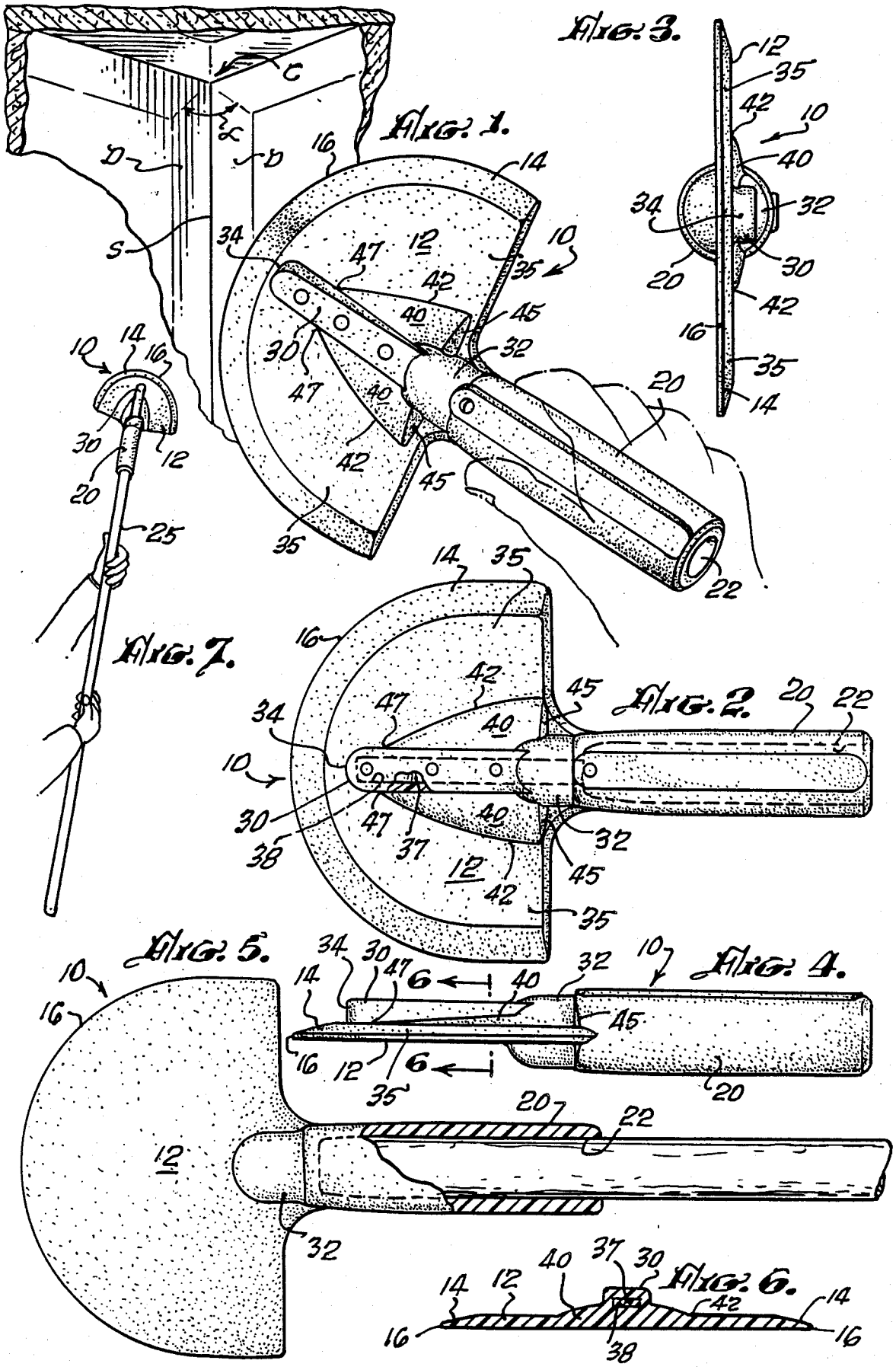
FIG. 1 is a pictorial representation of the finishing tool of the present invention in use.
FIG. 2 is a top plan view of the finishing tool of the present invention.
FIG. 3 is a view of the finishing tool of FIG. 2 looking toward the blade along the longitudinal axis thereof.
FIG. 4 is a side elevation of the finishing tool of FIG. 2.
FIG. 5 is a bottom plan view of the finishing tool of the present invention.
FIG. 6 is a sectional view of the finishing tool of FIG. 4 taken along line 6—6.
FIG. 7 illustrates a modification of the finishing tool of the present invention which encompasses a handle for extending its use in otherwise out of reach locations.

With reference now to the drawings, and in particular FIG. 1, a finishing tool constructed in accordance with the present invention is illustrated at 10. As previously stated, the tool has its primary utility in finishing a seam S at a corner C, in which contiguous drywall sheets D come together at an obtuse included angle alpha.

The tool of the present invention is capable of applying a taping or finishing compound, sometimes referred to in the industry as "mud", in a smooth and uniform layer so as to virtually obliterate the rough edges of the corner and any tape which may have been applied to the seam, to thereby cover up indentations made by fasteners such as nails or staples, and to provide an overall transitional smoothness to the area. This laudatory result is accomplished, in one aspect of the invention, by providing a blade 12 formed of relatively flexible material such as rubber. The blade, in the illustrated case, is preferably semi-circular in configuration, and is formed with a finishing edge 14 about its pheriphery which, as may be seen in FIGS. 3, 4 and 6, tapers towards a leading edge 16 at the outer terminus of said blade.

In order that the blade might be manipulated with ease by the user, a handle 20 protrudes longitudinally rearwardly from the radial center of the semi-circular blade 12. It has been found that by use of a thermo plastic rubber compound sold by Monsanto under the trademark Santo-Preme, the handle 20 and blade 12 may be formed as a unitary member, thereby greatly simplifying the construction as well as the cost of the tool. Other materials may be used without departure from the invention.

As illustrated, the handle 20 defines a cylindrical opening at 22, which is adapted to receive an extension member adapted to receive an extension 25, as seen in FIG. 7, thereby rendering the tool usable on such remote areas as in coffered ceilings, and remote upper corners of high walls.

In order to accomplish the objectives of the invention, it is necessary that the blade be deformable so as to conform to the corner C in which it is being used. However, it is vital to the success of the tool, that it not be so flexible as to be deformable by quantities of finishing compound, or by rough spots in, on, around, or about the corner itself. In other words, it is essential that the blade, while being flexible, is sufficiently firm as to permit the user to apply a uniform and smooth application of finishing compound in a manner which will smooth out any rough spots and give the finished seam S the smooth, seamless, appearance which is the ultimate objective. To this end, the upper surface of the blade 12 is provided with a centrally disposed, radial extending spine 30. The spine 30 commences at the junction area 32 of the blade 12 and handle 20, and extends away from the handle, radially outwardly towards the finishing edge 14 of the blade where it terminates at 34, dividing the blade into equal, left and right coplanar segments 35. FIGS. 1, 3 and 4 best illustrate this construction.

While it is acceptable to form the spine in the mold used to construct the unitary tool, it has been found that the rigidity required of the spine may be insufficient for all purposes. In order to insure proper rigidity, therefore, the invention contemplates the use of a metal insert 37, best seen in FIGS. 2 and 6, which will enhance the rigidity and control of the blade, and thus the utility of the tool. To this end, a pocket or slot 38 is formed in said blade for snug receipt of the spine 30.

It has also been found desirable, in most applications, to control the strength and flexibility of the blade 12, and to some extent the finishing edge 14 about the entire perimeter, so that application of pressure to the blades through the handle will be relatively uniformly applied over the pheriphery of the finishing edge. Whereas, the proximity of the terminus 34 of the spine to the leading edge 16 provides the proper rigidity along the longitudinal axis L—L of the tool, the relatively great distance between the leading edge 16 at other points along the semi-circle, and edge 16 at other points along the semicircle to the spine results in a flexibility which is greater than that needed for proper control of the finished surface. In order to enchance control, therefore, means is provided for stiffening the blade 12 to some extent, and this, in accordance with the present invention, is accomplished by means of the formation of tapered raised portions or wedges 40. The wedges 40 are formed intergrally with the spine, and extend outwardly therefrom in tapered fashion so as to blend into the upper surface of the blade 12 along their edges 42. By the same token, as seen in FIG. 4, the wedges are thickest at their trailing surface 45 close to the handle 20 and taper forwardly to a leading edge terminus 47 where, together with the edge 42, they blend into the upper surface of blade 12. As seen in FIGS. 1 and 2, the resultant configuration gives the appearance of an arrowhead pointing toward the finishing edge 14 of the blade 12.

In application, the addition of the wedges 40 will be seen to control the overall strength and flexibility of the blade 12 thereby enchancing the uniformity of application and pressure with which the tool may be used to form a smooth and seamless corner, thereby achieving the purposes and goals of the invention.

It will be appreciated that other means of stiffening the blade may be employed without departure from the invention. The present configuration was chosen, however, by virtue of its capacity for being intergrally formed, such as by molding, into a unitary tool.

Having thus described the preferred embodiment of the invention, what is claimed is:

1. A tool for finishing drywall surfaces in areas where there is a joinder of surfaces at an oblique angle, comprising:

a blade having an arcuate leading edge, a top surface and a bottom surface, said blade being formed of a relatively flexible material so that said blade is deformable to assume the contour of an area being finished;

a finishing surface formed about the periphery of said blade, said finishing surface being tapered from said top surface to said arcuate leading edge;

a handle attached to said blade to permit manipulation of said blade; and a rigid spine means secured to said blade along a longitudinal axis thereof for rigidly supporting said blade, said rigid spine means extending from said handle to a point in proximity of said finishing surface.

2. The tool as set for in claim 1, wherein said blade is semicircular in configuration, and said rigid spine means is disposed along a portion of the radius of said blade so as to divide said blade into substantially equal, relatively flexible quadrants.

3. The tool as set forth in claim 1, wherein said handle defines a cylindrical opening for receipt of an extension means therein.

4. The tool as set forth in claim 1, wherein said blade and handle are unitary and formed of the same material, and said rigid spine means is inserted in said blade.

5. The tool as set forth in claim 4, wherein a pocket is formed in said blade for receipt of said rigid spine means.

6. The tool as set forth in claim 2, wherein said blade and handle are unitary and formed of the same material, and said blade further comprises a pocket formed therein for receipt of said rigid spine means, and said blade includes means defining a tapered raised portion which extends outwardly along said top surface of said blade from said rigid spine means so as to provide strength and uniform flexibility to said finishing surface.

7. The tool as defined in claim, 1 further comprising a strengthening means for providing strength and uniform flexibility to said finishing surface, said strengthening means including a raised portion positioned symmetrically about said rigid spine means which tapers towards said top surface away from said rigid spine means, said raised portion being wider towards that end of said rigid spine means closest to said handle and narrowing toward said rigid spine means along its length.

8. The tool as set forth in claim 6, wherein said rigid spine means is a metallic bar and is inserted into said pocket.

* * * * *